US005899141A

United States Patent [19]

Gross et al.

[11] Patent Number: 5,899,141

[45] Date of Patent: May 4, 1999

[54] METHOD OF CRUSHING AN OIL FILTER

[76] Inventors: John D. Gross, 1291 E. Vista Way, Suite 113; Zeno P. Traub, 1204 Coventry Rd., both of Vista, Calif. 92084

[21] Appl. No.: 09/140,299

[22] Filed: Aug. 25, 1998

Related U.S. Application Data

[62] Division of application No. 08/853,052, May 8, 1997, Pat. No. 5,857,407

[60] Provisional application No. 60/019,130, Jun. 3, 1996.

[51] Int. Cl.[6] ..... B30B 9/32; B30B 1/23; B30B 9/04

[52] U.S. Cl. ..... 100/37; 100/125; 100/270; 100/289; 100/902

[58] Field of Search ..... 100/35, 37, 125, 100/131, 270, 271, 289, 902; D15/123

[56] References Cited

U.S. PATENT DOCUMENTS

| | | | |
|---|---|---|---|
| D. 355,425 | 2/1995 | Weaver | D15/123 |
| 3,079,856 | 3/1963 | Swartz | 100/902 |
| 3,411,184 | 11/1968 | McGowan | 100/289 |
| 4,095,459 | 6/1978 | Feldt | 100/110 |
| 4,570,536 | 2/1986 | Dodd . | |
| 4,927,085 | 5/1990 | Oberg . | |
| 5,109,763 | 5/1992 | Morris et al. . | |
| 5,125,331 | 6/1992 | Wood . | |
| 5,136,934 | 8/1992 | Darby, Jr. . | |
| 5,165,334 | 11/1992 | Aluotto et al. . | |
| 5,174,199 | 12/1992 | King et al. . | |
| 5,182,842 | 2/1993 | Ross et al. . | |
| 5,182,988 | 2/1993 | Styfhoorn . | |
| 5,214,830 | 6/1993 | Rozycki . | |
| 5,274,906 | 1/1994 | Ter Haar | 100/902 |
| 5,279,215 | 1/1994 | Harder . | |
| 5,297,479 | 3/1994 | Negus . | |
| 5,303,643 | 4/1994 | Fisher et al. . | |
| 5,325,771 | 7/1994 | Morris . | |
| 5,331,888 | 7/1994 | Brown, Jr. . | |
| 5,337,656 | 8/1994 | Hollnagel . | |
| 5,383,397 | 1/1995 | Battles et al. . | |
| 5,669,296 | 9/1997 | Newton | 100/289 |

FOREIGN PATENT DOCUMENTS

| | | |
|---|---|---|
| 0 536 691 A2 | 4/1993 | European Pat. Off. . |
| 90 03 402 | 7/1990 | Germany . |
| WO 81/02802 | 10/1981 | WIPO . |

*Primary Examiner*—Stephen F. Gerrity
*Attorney, Agent, or Firm*—Brown, Martin, Haller & McClain

[57] ABSTRACT

An oil filter crusher includes a frame, a threaded drive screw, and a ram assembly, but does not include any actuator for driving the screw. Rather, a first end of the drive screw has a drive head to which a user may couple a conventional wrench, such as a pneumatic impact wrench of the type commonly used in automotive service centers. A thrust bearing assembly couples the second end of the drive screw to the ram assembly. A threaded portion of the drive screw engages a threaded opening in a portion of the frame. The ram assembly thus moves in an axial direction in response to rotation of the drive screw with respect to the frame. Rotating the drive screw in one direction moves it toward the filter to be crushed, and rotating it in the opposite direction moves it away from the filter.

3 Claims, 2 Drawing Sheets

METHOD OF CRUSHING AN OIL FILTER

CROSS-REFERENCE TO RELATED APPLICATIONS

This is a divisional of application Ser. No. 08/853,052, filed May 8, 1997 (now U.S. Pat. No. 5,857,407), which claims the benefit of the filing date of U.S. Provisional application Ser. No. 60/019,130, filed Jun. 3, 1996.

BACKGROUND OF THE INVENTION

1. Field of the Invention

The present invention relates generally to compacting and crushing devices and, more specifically, to an oil filter crusher that can be operated by a conventional pneumatic or electric impact wrench.

2. Description of the Related Art

Automotive service centers, including commercial truck fleet service centers, in the United States and other countries change millions of automobile and truck oil filters each year. Retail automotive supply stores sell millions of oil filters to people who change their own vehicle's oil. Oil filters of various sizes and types are known, but an oil filter generally consists of a metal housing in which is disposed a paper filter element.

An oil filter crusher is used to crush or compact an oil filter that has been removed from an automobile or other vehicle after a period of use. Not only does compaction facilitate temporary bulk storage of used oil filters by minimizing their volume, but it also facilitates recovery of residual oil that has economic value. Although many types of oil filter crushers are known, a conventional oil filter crusher typically includes a reciprocating ram that is driven by a hydraulic or electric actuator. When a filter is positioned in the crusher, the actuator drives the ram toward the filter. The residual oil that drains from the filter during crushing may collect in a pan or container. After crushing, the actuator retracts the ram. The crushed filter may then be removed for disposal or recycling as scrap metal.

Conventional oil filter crushers are uneconomical because they typically include, among other uneconomical components, an integral hydraulic, pneumatic or electric actuator. Although certain service centers may change a sufficient number of oil filters per year to justify the cost of purchasing a conventional oil filter crusher, the majority of service centers do not. Furthermore, many conventional oil filter crushers are intended for bulk operation and are simply too large to be conveniently located in a typical service center. For these reasons, smaller service centers typically send their (uncrushed) collected filters to a regional oil filter recycling service, which then crushes the filters in bulk.

Oil filter crushers not having powered actuators are known in the art. U.S. Pat. No. D355,425, issued to Weaver, shows an oil filter crusher having a threaded drive screw with a hexagonal head. The crusher is of a simplistic design, with a disc-shaped ram apparently fixedly mounted on the end of the drive screw opposite the end having the hexagonal head. U.S. Pat. No. 5,274,906, issued to ter Haar, describes an oil filter crusher having a threaded screw drive that may be driven using a pneumatic wrench. Nevertheless, its design is uneconomical. Furthermore, although the end of the drive screw is rotatably mounted to the ram, the rotatable mounting appears prone to substantial frictional resistance.

It would be desirable to provide an economical oil filter crusher that can be quickly and easily used by automotive service center personnel. The crusher should be easy to use and unobtrusive. Such a crusher would be desirable not only to automotive service centers but also to retail automotive supply stores, which could offer a crushing service to people who purchase filters from them to complement the used oil recovery services that many such stores currently offer. These needs are clearly felt in the art and are satisfied by the present invention in the manner described below.

SUMMARY OF THE INVENTION

The present invention relates to an oil filter crusher that includes an elongated frame, a threaded drive screw, and a ram assembly, but does not include any actuator for driving the screw. Rather, a first end of the drive screw has a drive head to which a user may couple a conventional wrench, such as a pneumatic impact wrench of the type commonly used in automotive service centers. A thrust bearing couples the second end of the drive screw to the ram assembly. A threaded portion of the drive screw engages a threaded opening in a portion of the frame. The ram assembly thus moves in an axial direction in response to rotation of the drive screw with respect to the frame. Rotating the drive screw in one direction moves it toward the filter to be crushed, and rotating it in the opposite direction moves it away from the filter.

The inclusion of a drive head, such as a hexagonal bolt head, to which a conventional wrench may be coupled to drive the screw and the exclusion of an uneconomical actuator enables the invention to be manufactured economically and sold to lower-volume service centers that might not purchase a less economical oil filter crusher. Not only does this arrangement maximize economy, but it also enhances ease of use. Service center personnel almost always have pneumatic impact wrenches close at hand, and they are comfortable using such wrenches. Service center personnel rely upon impact wrenches and will immediately recognize the practical association of the crusher of the present invention with the ease and efficiency of operation. To crush a filter, the user may simply place the filter at the second end of the frame, engage the drive head with the impact wrench socket, and activate the wrench. In response to the rotation of the screw, the ram assembly moves toward the second end of the frame and crushes the filter. Although a user may alternatively drive the screw manually using a hand wrench, a power wrench of the type commonly used in automotive service centers is preferred.

Furthermore, the thrust bearing provides important advantages. In the absence of a thrust bearing, the friction between the ram assembly and the filter would inhibit crushing, and the applied torque could damage the drive screw and other parts.

The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein.

DESCRIPTION OF A PREFERRED EMBODIMENT

Figure 1:
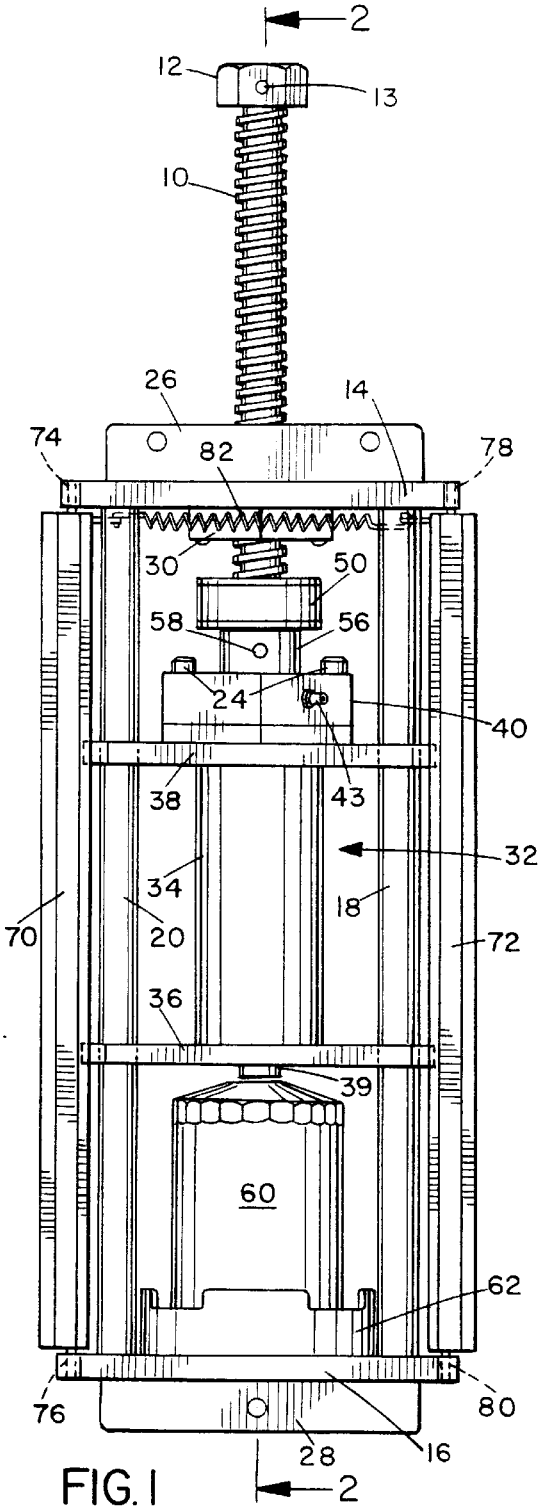
FIG. 1 is a rear view of an oil filter crusher.

As illustrated in FIGS. 1–6, a preferred oil filter crusher includes a drive screw 10 having a hexagonal drive head 12. The oil filter crusher further includes a triangular top plate 14, a triangular bottom plate 16, and three guide shafts 18, 20 and 22 that define a frame. Screw fasteners 24, which are preferably grade 5 or above standard nuts and bolts, fasten the upper ends of shafts 18, 20 and 22 to top plate 14 and the lower ends of shafts 18, 20 and 22 to bottom plate 16. Shafts 18, 20 and 22 are fastened to portions of plates 14 and 16 that are adjacent to their corners or vertices. The frame further includes a top mounting bracket 26 fastened to upper plate 14 and a bottom mounting bracket 28 fastened to lower plate 16.

The triangular shape of the frame maximizes manufacturing economy because only three guide shafts 18, 20 and 22 and their associated fasteners 24 are used. A frame having more than three guide shafts would be more in line with conventional machinery design principles but is less preferable because it would be less economical. A frame having fewer than three guide shafts is less preferable because it could be damaged in response to relative torque between the frame and drive screw during use.

The frame further includes a drive nut 30 fastened to the lower surface of upper plate 14. Drive nut 30 has a threaded opening in which drive screw 10 is engaged. To inhibit frictional binding or seizing, drive nut 30 is preferably made of a metal dissimilar to that of which drive shaft 10 is made. For example, drive shaft 10 may be made of cold-rolled steel, and drive nut 30 may be made of brass. Furthermore, the play or size differential between the interengaging surfaces of the threads of drive nut 30 and the threads of drive shaft 10 is preferably slightly greater than that of a conventional mating nut and screw to further inhibit binding when torque is applied.

A ram assembly 32 is mounted on the end of drive screw 10 opposite that at which drive head 12 is mounted. Ram assembly 32 includes a cylindrical ram spacer 34, a lower ram plate 36 and an upper ram plate 38. Ram plates 36 and 38 are preferably welded to ram spacer 34. Ram plates 36 and 38 have openings adjacent their corners or vertices through which guide shafts 18, 20 and 22 extend. Ram assembly 32 is thus slidable upwardly and downwardly between upper and lower plates 14 and 16 on guide shafts 18, 20 and 22.

Figure 2:
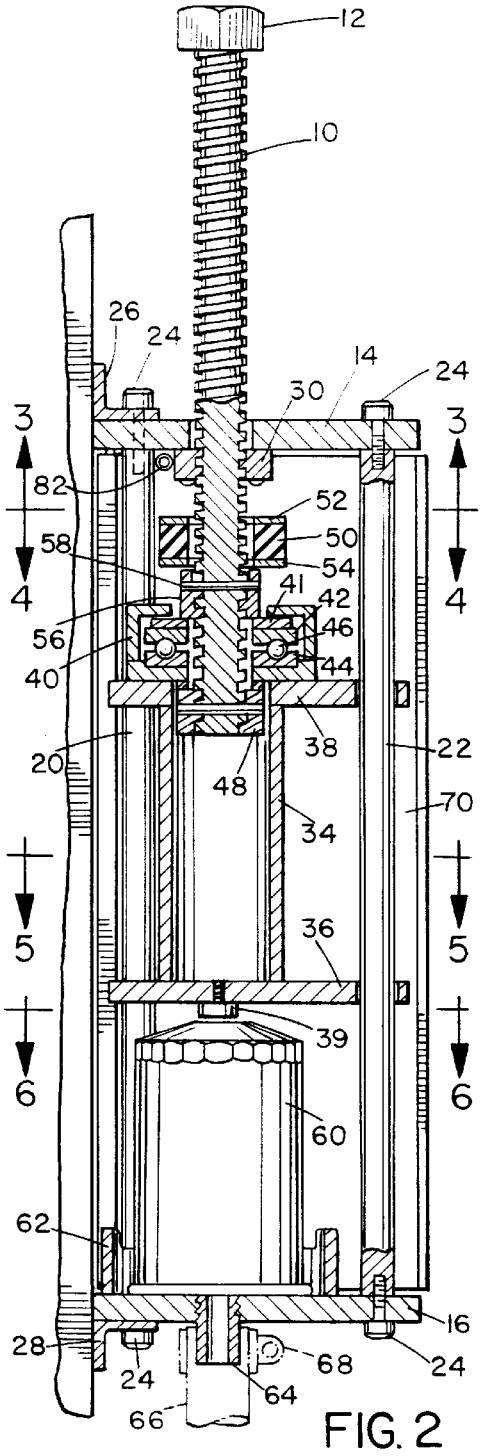
FIG. 2 is a sectional view taken on line 2—2 of FIG. 1.
Figure 3:
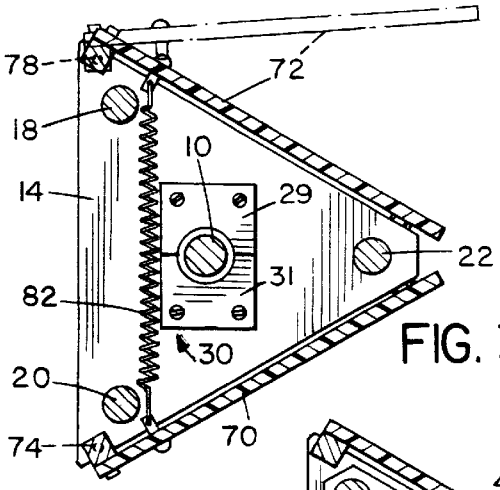
FIG. 3 is a sectional view taken on line 3—3 of FIG. 2.
Figure 4:
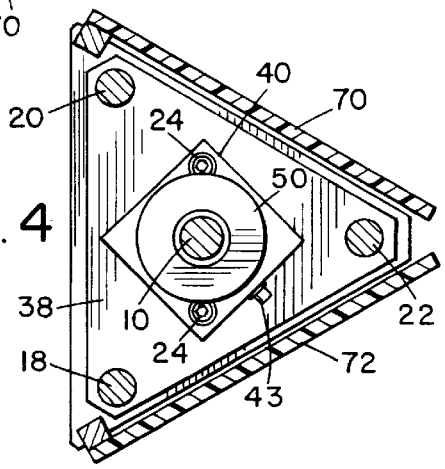
FIG. 4 is a sectional view taken on line 4—4 of FIG. 2.
Figure 5:
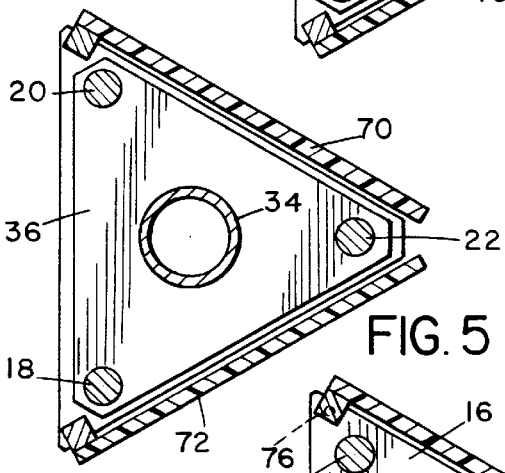
FIG. 5 is a sectional view taken on line 5—5 of FIG. 2.
Figure 6:
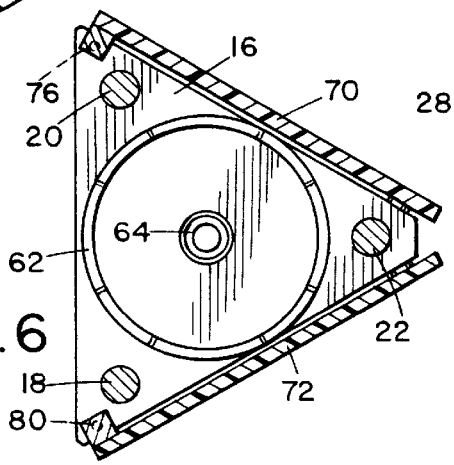
FIG. 6 is a sectional view taken on line 6—6 of FIG. 2.

An externally lubricated dedicated ball-type thrust bearing assembly 40 is fastened to the upper surface of upper ram plate 38 by additional fasteners 24. As shown in FIG. 2, thrust bearing assembly 40 includes a load-bearing washer 41 and bearing races 42 and 44, between which are captured ball bearings 46. A grease fitting 43, also known as a Zerk fitting, allows external lubrication. The end of drive screw 20 is fastened to thrust bearing assembly 40 by a nut 48. Thrust bearing assembly 40 is an important feature of the invention because it minimizes frictional forces, thereby allowing a greater compaction force to be applied.

A bumper ring 50 made of a suitable resilient material such as polyurethane is disposed around drive screw 10 between two bumper washers 52 and 54. Bumper ring 50 and washers 52 and 54 are all disposed between the upper portions of thrust bearing assembly 40 and the lower portions of drive nut 30. A nut 56, machined to have a rounded outside surface, is disposed between bumper washer 54 and thrust bearing assembly 40 and secured to drive screw 10 by a pin 58 extending diametrically therethrough. Nut 56 transmits the load from drive screw 10 to thrust bearing assembly 40.

The oil filter 60 to be crushed may be placed in a retaining ring 62, which is mounted, preferably by welding, to the upper surface of bottom plate 16. A threaded end of a nipple 64 engages the opening in bottom plate 16 to provide a path for oil to drain as filter 60 is crushed. A hose 66 may be attached to the other end of nipple 64 by a hose clamp 68 or other suitable means.

To guard against fingers and unwanted objects accidentally entering the crusher during operation, the frame includes two safety doors 70 and 72 that are preferably made of transparent high-impact plastic, such as PLEXIGLAS. Safety door 70 is mounted on hinge pins 74 and 76 to top plate 14 and bottom plate 16, respectively. Safety door 72 is mounted on hinge pins 78 and 80 to top plate 14 and bottom plate 16, respectively. Each end of a spring 82 is attached to one of doors 70 and 72 to bias them closed.

The oil filter crusher is preferably mounted on a wall of a building, such as an automotive service center, using mounting brackets 26 and 28. This mounting feature not only braces the frame of the crusher against turning but also enables the crusher to be mounted relatively unobtrusively in the building.

In certain embodiments of the invention the triangular cross-sectional shape of the frame may facilitate mounting it in a manner that further braces it against movement when torque is applied to drive screw 10. For example, although in the illustrated embodiment the frame has a cross-sectional shape similar to an equilateral triangle, in other embodiments the frame may have a shape similar to a right triangle. If such a crusher is mounted such that the ninety degree vertex of the triangular frame is disposed in a corner where two walls of the building meet, the crusher would be securely braced against undesirable turning.

Figure 7:
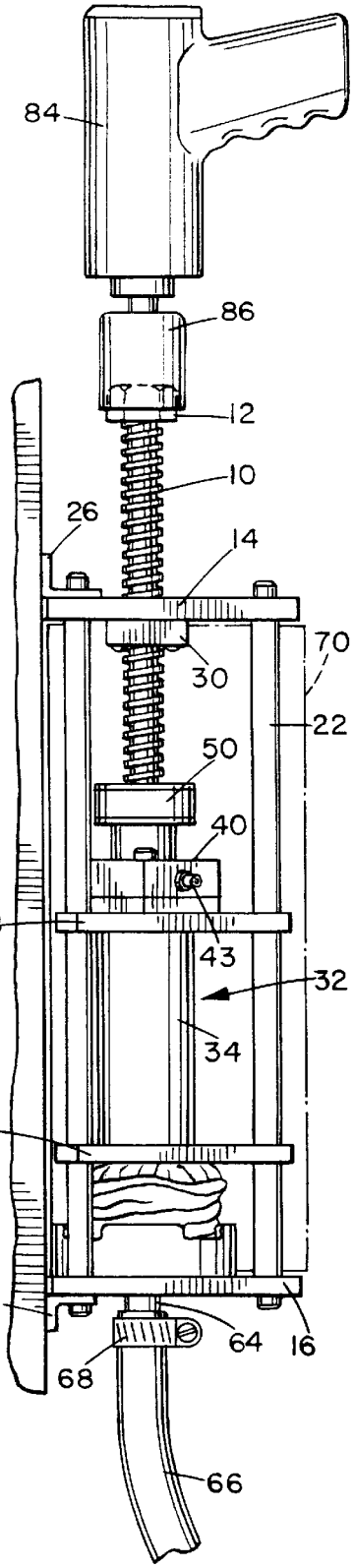
FIG. 7 is a side elevation view with the near protective door removed for purposes of clarity, showing the crushing action using an impact wrench.

To crush a filter 60, the user opens one of safety doors 70 and 72, places filter 60 in retaining ring 62 on bottom plate 16, and removes his hand, allowing the door to swing shut. Filter 60 is preferably placed in an orientation such that its opening (not shown) is on bottom plate 16. As illustrated in FIG. 7, the user preferably engages drive head 12 with a power wrench 84, such as a pneumatic impact wrench of the type commonly used in automotive service centers. Power wrench 84 has a socket 86 with a hexagonal opening that corresponds to the hexagonal shape of drive head 12.

The user then activates wrench 84. Wrench 84 applies torque to drive head 12, thereby rotating drive screw 10. Drive head 12 is preferably made of case-hardened steel to withstand the torque applied to it under repeated use. In response to the rotation, drive screw 10 moves axially downwardly in drive nut 30, urging ram assembly 32 into contact with filter 60. As ram assembly 32 moves downwardly, filter 60 is crushed between lower ram plate 36 and bottom plate 16. The residual oil is squeezed out of filter 60 directly into the drain opening in bottom plate 16 because the opening in filter 60 is directly above the drain opening in bottom plate 16. Retaining ring 62 centers filter 60 over the opening in bottom plate 16 and retains filter 60 in that position during crushing. Retaining ring 62 thus also centers filter 60 directly below ram assembly 32 where filter 60 receives maximum crushing force.

The triangular shape of the frame provides exceptional strength and resistance to deformation as a result of the applied torque. The crushing force is dissipated through the frame and evenly distributed among guide shafts 18, 20 and 22 because they are symmetrically arrayed with respect to filter 60, ram assembly 32 and drive screw 10.

When the user observes that filter 60 has been sufficiently crushed or, alternatively, when wrench 84 resists further application of torque, the user reverses the direction of wrench 84. In response to the reverse rotation, drive screw 10 moves axially upwardly in drive nut 30. Because there is essentially no resistance to the torque applied, drive screw 10 and ram assembly 32 may move upwardly very rapidly. The movement may be too rapid for the user to precisely stop wrench 84 when ram assembly 32 has risen a sufficient distance to remove the crushed filter and position another filter to be crushed. Resilient bumper 50 absorbs the impact if ram assembly 32 should rise too rapidly for a user to stop it before it hits bumper 50, thereby preventing excessive wear or damage to the parts.

The oil filter crusher of the present invention may be manufactured in any suitable size to accommodate any type of automobile or truck oil filters. Although the triangular shape is economical and enhances bracing, other shapes are suitable. In addition, thrust bearing assembly 40 allows application of very large crushing forces that could otherwise damage the crusher. The crusher is easy to operate with existing power tools that are readily available to automotive service personnel. Nevertheless, it can be operated manually using a hand wrench or similar hand tool.

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

What is claimed is:

1. A method for using an oil filter crusher, said oil filter crusher comprising a frame having first and second ends with a drain at said second end, a threaded drive screw having a shaft extending between first and second ends and engaging a threaded opening of said frame, a drive head at said first end of said drive screw, and a ram assembly including a thrust bearing assembly coupling said ram assembly to said second end of said drive screw, said method comprising the steps of:

disposing an oil filter between said ram assembly and said second end of said frame;

coupling an impact wrench to said drive head; and activating said impact wrench until said ram assembly moves axially toward said second end of said frame in response to rotation of said drive screw by said impact wrench and crushes said oil filter, said thrust bearing receiving a force transmitted by axial movement of said second end of said drive screw.

2. The method recited in claim 1, wherein:

said drive head has a polygonal shape; and said impact wrench has a socket having a shape corresponding to said polygonal shape for engaging said drive head.

3. The method recited in claim 1, wherein said impact wrench is pneumatic.

* * * * *